United States Patent [19]

Khoury

[11] 4,019,648

[45] Apr. 26, 1977

[54] CHILDPROOF CLOSURE

[75] Inventor: Nick S. Khoury, Worth, Ill.

[73] Assignee: The Continental Group, Inc., New York, N.Y.

[22] Filed: Mar. 11, 1976

[21] Appl. No.: 666,109

Related U.S. Application Data

[63] Continuation of Ser. No. 578,686, May 19, 1975, abandoned.

[52] U.S. Cl. ..... 220/273

[51] Int. Cl.[2] ..... B65D 41/32

[58] Field of Search ..... 220/269–273, 220/375

[56] References Cited

UNITED STATES PATENTS 3,744,666 7/1973 Heffner ..... 220/269

3,796,344 3/1974 De Phillips ..... 220/269

*Primary Examiner*—George T. Hall

*Attorney, Agent, or Firm*—Paul J. Lerner; Joseph E. Kerwin; John J. Kowalik

[57] ABSTRACT

A child resistant safety closure for an easy-open can has a tether which restrains movement of the pull tab. The tether is integral with the tab and extends into the interior of the tab ring. The distal end of the tether is removably attached to an auxiliary rivet formed in the end panel. Opening the container requires application of sufficient force to cause disengagement of the tether from the auxiliary rivet. This is beyond the experience or physical capabilities of small children.

11 Claims, 6 Drawing Figures

CHILDPROOF CLOSURE

This is a continuation of Ser. No. 578,686, filed May 19, 1975, now abandoned.

SUMMARY OF THE INVENTION

It is well known that the accumulation of medicine and household chemicals commonly found in the home poses the threat of death or serious injury to small children. Storage of these materials in places supposedly beyond the reach of such children has not proven wholly satisfactory. It is, therefore, one of the important objects of the present invention to provide an improved safety or security closure for a standard easy-open container which may be readily removed by an adult but which will frustrate efforts of small children to open the container.

It is a further object to provide an improved security closure wherein the standard easy-open closure may be employed with a minimum of modification thereto.

It is another object to provide an improved security closure that provides the adult user with visual clues as to its method of operation while retaining its child-resistant features.

BRIEF DESCRIPTION OF THE DRAWINGS

The various features and advantages of the security closure of this invention will be more apparent from the following detailed description when considered in connection with the accompanying drawing wherein.

DESCRIPTION OF THE FIRST PREFERRED EMBODIMENT (FIGS. 1–3)

Figure 1:
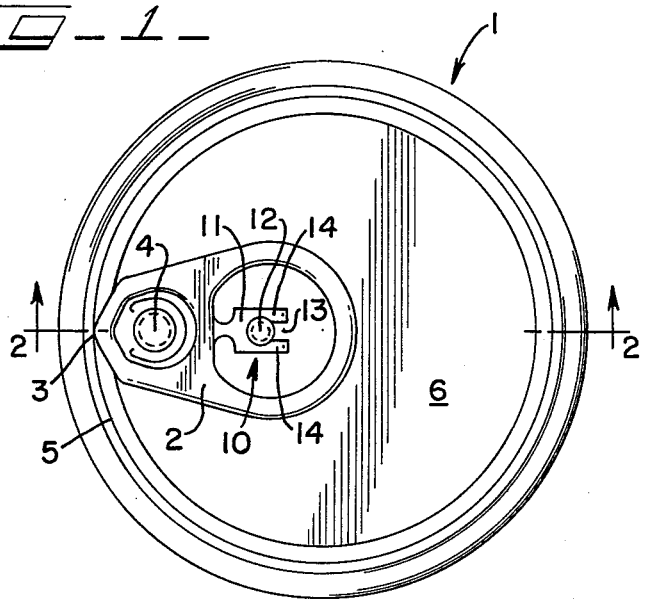
FIG. 1 is a top plan view of the end closure of the present invention.
Figure 2:
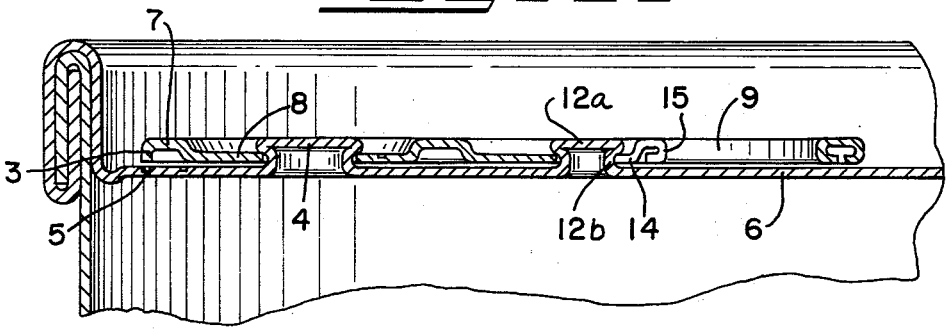
FIG. 2 is a fragmentary cross-sectioned view taken substantially along line 2—2 of FIG. 1.

As shown in the drawings, the safety closure of this invention includes an end panel 1, at tab 2 with integral piercing member 3, a rivet 4 fastening the tab 2 to the end panel 1 and a score 5 formed in the end panel 1 and therein defining a flap 6. The tab 2 comprises a nose portion 7, an intermediate portion 8 and a ring or lift portion 9.

In the standard easy-open closure, opening is accomplished by vertically displacing the pull tab 2, thereby pivoting the pull tab 2 about the rivet 4 and impressing a downward force on the piercing member 3, said force resulting in the fracturing of the end panel 1 along the score 5 beneath said piercing member 3. Continued upward displacement of the pull tab 2 results in controlled tearing of the end panel 1 along the score 5. The flap 6 defined by the score 5 is then removed by pulling the tab 2 thereby causing further tearing along the score 5 until the flap 5 separates from the remainder of the end panel 1.

In the safety closure of the invention, retention means 10 is provided which restrains lifting of the tab 2, said retention means 10 comprising tether means 11 and an auxiliary rivet 12 integrally formed in the end panel and cooperating with the tether means 11.

The tether means 11 is integral with the ring portion 9 and extends into the interior of the ring portion 9 from the point on the periphery of the ring portion 9 nearest the nose portion 7. The distal end of the tether means 11 is formed with a generally U-shaped opening 13 which extends to the outer periphery of said tether means 11, defining thereby two legs 14. The distal or free ends of the legs 14 are folded to form collapsible hems 15.

The auxiliary rivet 12 comprises a head **12*a* and a shank 12*b*. The diameter of the rivet head 12*a* exceeds the width of the opening 13, while the clearance between the end panel 1 and the rivet head 12*a* is less than the height of the hems 15**.

Figure 3:
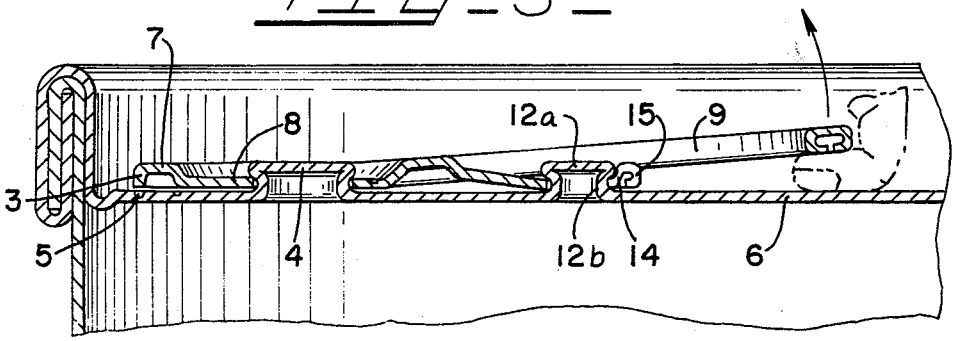
FIG. 3 is a fragmentary cross-sectional view similar to FIG. 2 illustrating the tether in restraining position.
Figure 4:
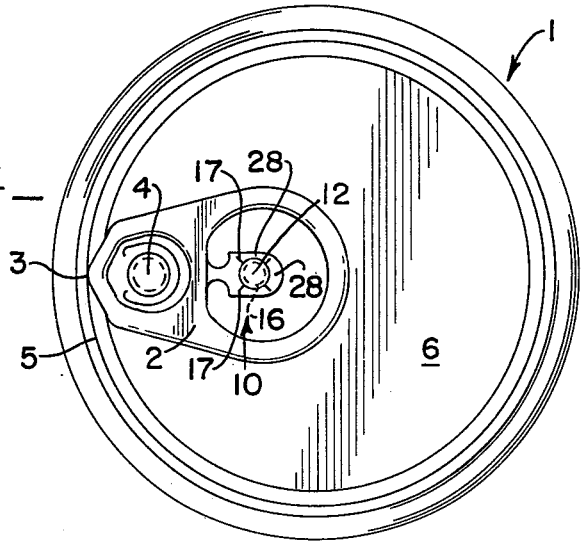
FIG. 4 is a top plan view of a second embodiment of the present invention.
Figure 5:
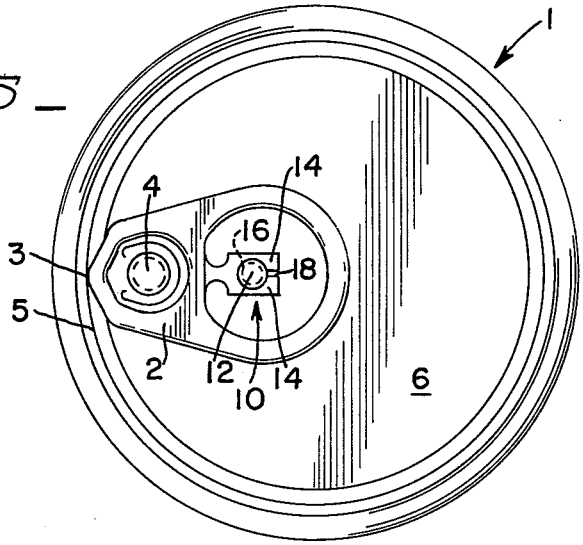
FIG. 5 is a top plan view of a third embodiment of the present invention.
Figure 6:
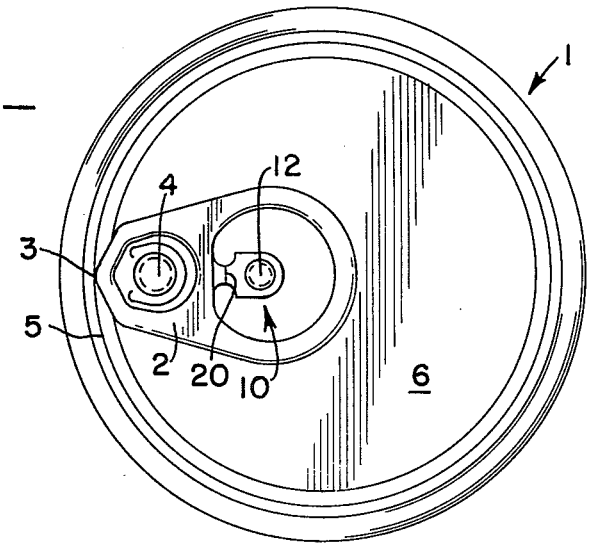
FIG. 6 is a top plan view of a fourth embodiment of the present invention.

As best illustrated in FIG. 3, the effect of the retention means 10 is to prevent the displacement of the tab 2, sufficient to bring the piercing member 3 into contact with the score 5. This limitation is caused by the interference between the hems 15 and the auxiliary rivet head **12*a*. To open the closure, an additional force must be applied in lifting the tab 2. This force causes the hems 15 to be pulled against the rivet head 12*a*. When the force on the hems 15 exceeds a predetermined level, they distort, becoming reduced in height such that they can pass beneath the rivet head 12*a*, thereby releasing the restraint on movement of the tab 2**. The closure may now be opened in the conventional manner. The method of operation as described is beyond the experience of children and beyond the physical capabilities of small children.

DESCRIPTION OF THE SECOND PREFERRED EMBODIMENT (FIG. 4)

In this embodiment, the distal end portion 12 of the tether means 11 is formed with a circular opening 16 through which passes the shank **12*b* of the auxiliary rivet 12. The diameter of the rivet head 12*a* exceeds the diameter of the opening 16. A plurality of auxiliary scores 17 are formed in the distal end portion 12 radiating outwardly from the opening 16 and defining petals 28** therebetween.

When sufficient force is applied in lifting the tab 2, the auxiliary scores 17 fracture and the petals 28 bend inwardly, away from the rivet head **12*a*, thereby enlarging the opening 16 and permitting the tether means 11 to be freed from the rivet 12 and releasing the tab 2** from restraint. The closure may now be opened in the conventional manner as described hereinabove.

It is contemplated that slits may be substituted for the auxiliary scores 17 without departing from the spirit of this embodiment.

DESCRIPTION OF THE THIRD PREFERRED EMBODIMENT (FIG. 5) .

In this embodiment, the distal end of the tether means 11 is formed with a slot 18 connecting with the opening 16 and communicating with the exterior of the tether means 11. The width of the slot 18 is smaller than the diameter of the rivet shank **12*b*. The slot 18 defines two legs 14 in the distal end portion 12 of the tether means 11**.

When sufficient force is applied in lifting the tab 2, the legs 14 are forced outwardly, allowing the rivet shank 12*b* to pass therebetween, thereby permitting the tether means 11 to be freed from the rivet 12. The closure may now be opened in the conventional manner.

DESCRIPTION OF THE FOURTH PREFERRED EMBODIMENT (FIG. 6)

In this embodiment, a transverse score 20 is formed in the tether means 11 between the circular opening 16 and the point of junction with the ring portion 9 of the tab 2.

When sufficient force is applied in lifting the tab 2, the transverse score 20 will fracture, thereby freeing the tab 2 from restraint. The closure may now be opened in the conventional manner as described hereinabove.

I claim:

1. An improved safety closure for use on a can or similar container comprising an end panel, a score formed in said end panel and defining an opening flap therein, a pull tab secured to said end panel and having means for fracturing said score to open said consequent to lifting of said tab, retention means for restraining lifting of said tab to fracture said score, and programmable release means for releasing said tab upon application of a preprogrammed force for opening said container, said tab comprising a lift portion, an intermediate portion and a nose portion, said retention means comprising tether means on said lift portion of said tab, and an auxiliary rivet integrally formed in said end panel retainingly cooperative with said tether means.

2. The invention as described in claim 1, wherein said tether means is integral with the periphery of said ring portion at the point on said periphery nearest said nose portion.

3. The invention as described in claim 1, wherein said auxiliary rivet comprises a shank passing through an opening formed in the distal end portion of said tether means, said auxiliary rivet having a head larger than the opening opposing said panel and overlying the tether.

4. The invention as described in claim 3, wherein said opening is substantially U-shaped and communicates to the outer periphery of said tether means, defining thereby two legs in said distal end portion of said tether means, the distal ends of said legs being folded to form hems, the height of said hems exceeding the clearance between the head of said auxiliary rivet and said end panel.

5. The invention as described in claim 4 wherein said hems are collapsible upon application of sufficient force in lifting said ring portion of said tab whereby said hems are adapted to pass beneath said rivet head thereby freeing said tab and permitting opening of said container.

6. The invention as described in claim 3, wherein a plurality of auxiliary scores are formed in said distal end portion of said tether means radiating outwardly from the periphery of said opening, defining petals therebetween, whereby application of sufficient force in lifting said ring portion causes fracture of said auxiliary scores and bending of said petals thereby enlarging said opening to permit said opening to permit said tether means to slip over said rivet head, freeing said tab and permitting opening of said container.

7. The invention as described in claim 3, wherein a plurality of slits are formed in said distal end portion of said tether means radiating outwardly from the periphery of said opening, whereby application of sufficient force in lifting said ring portion of said tab causes bending of said tether means between said slits thereby enlarging said opening to permit said tether means to slip over said rivet head, freeing said tab and permitting opening of said container.

8. The invention as described in claim 3, wherein a slot is formed in said distal end portion of said tether means connected with said opening and communicating with the distal end of said tether means, said slot being narrower than the shank of said auxiliary rivet.

9. The invention as described in claim 8, wherein said slot defines two legs in said distal end portion of said tether means, said legs being distortable upon application of sufficient force in lifting said ring portion of said tab whereby said legs bend outwardly around said shank of said auxiliary rivet thereby permitting said tether means to be pulled off said rivet, freeing said tab and permitting opening of said container.

10. The invention as described in claim 3, wherein a transverse score is formed in said tether means between said opening for said auxiliary rivet and said ring portion of said tab, said score being fracturable upon application of sufficient force in lifting said ring portion of said tab, thereby freeing said tab and permitting opening of said container.

11. An improved pull tab comprising a nose portion, an intermediate portion and a lift portion with a finger aperture therein, and tether means integrally formed with the tab from the material displaced to form the finger aperture, said tether means including means for attachment of a distal end thereof to an associated container end panel, said attachment means being adapted for release upon application of a preprogrammed force to said lift portion.

* * * * *

UNITED STATES PATENT AND TRADEMARK OFFICE

CERTIFICATE OF CORRECTION

PATENT NO. : 4,019,648

DATED : April 26, 1977

INVENTOR(S) : Nick S. Khoury

It is certified that error appears in the above-identified patent and that said Letters Patent are hereby corrected as shown below:

Claim 1, line 5 should read as follows:

--means for fracturing said score to open said flap consequent--

Signed and Sealed this

*second* Day of *August 1977*

[SEAL]

*Attest:*

RUTH C. MASON
*Attesting Officer*

C. MARSHALL DANN
*Commissioner of Patents and Trademarks*